United States Patent [19]

Fujiwara

[11] 3,961,759

[45] June 8, 1976

[54] AUTOMATIC WEB-WINDING ROUND APPARATUS

[75] Inventor: Haruyoshi Fujiwara, Mihara, Japan

[73] Assignee: Beloit Corporation, Beloit, Wis.

[22] Filed: Dec. 13, 1974

[21] Appl. No.: 532,313

[52] U.S. Cl. ..... 242/66

[51] Int. Cl.[2] ..... B65H 17/08

[58] Field of Search ..... 242/65, 66, DIG. 3

[56] References Cited

UNITED STATES PATENTS

| | | | |
|---|---|---|---|
| 2,697,386 | 12/1954 | Lane | 242/66 X |
| 3,498,557 | 3/1970 | Ball | 242/66 X |
| 3,537,664 | 11/1970 | Mallie et al. | 242/66 |

*Primary Examiner*—Stanley N. Gilreath
*Assistant Examiner*—John M. Jillions
*Attorney, Agent, or Firm*—Dirk J. Veneman; Bruce L. Samlan; Gerald A. Mathews

[57] ABSTRACT

A remote controlled apparatus for automatically starting a web winding around a core, comprising a first and second winding drum, a rider roll nipping the core against the winding drums. A pair of plates positionable into contact with the rider roll and the winding drums, thereby enclosing the pocket between said winding drums and said rider roll. A web holding means located underneath the winding drums and engageable with the first winding drum, thereby preventing the leading end of a severed web from falling down between the winding drums. With the web nipped between the first winding drum and the core, the first plate diverts the web into the nip between the rider roll and the core, passing through the nip, the second plate diverts the web into the nip between the second winding drum and the core, passing through the nip, the web holding means diverts the web upward into the nip between the first winding drum and the core, thereby completing one full web wrap about the core and the web winding thereon, without the use of adhesives on the core.

3 Claims, 20 Drawing Figures

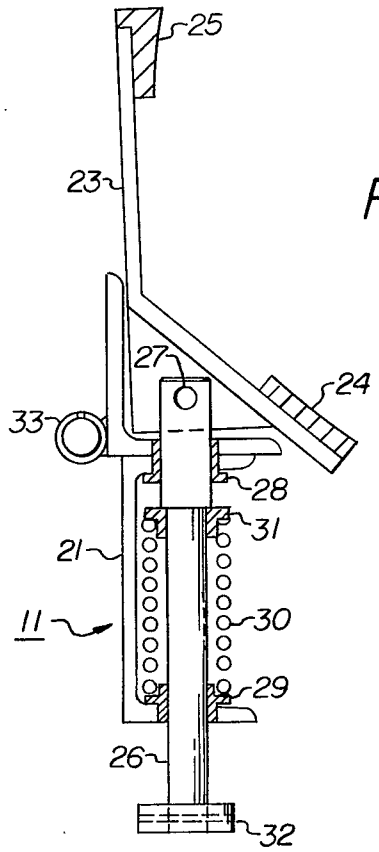
FIG. 7
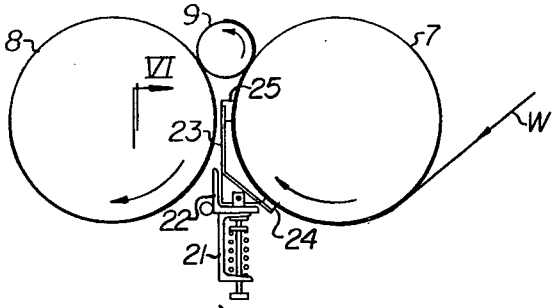
FIG. 5
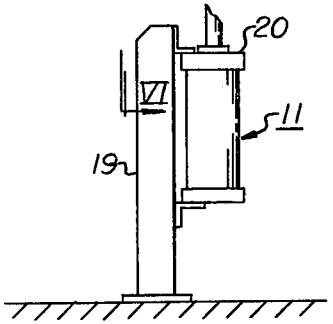
FIG. 6
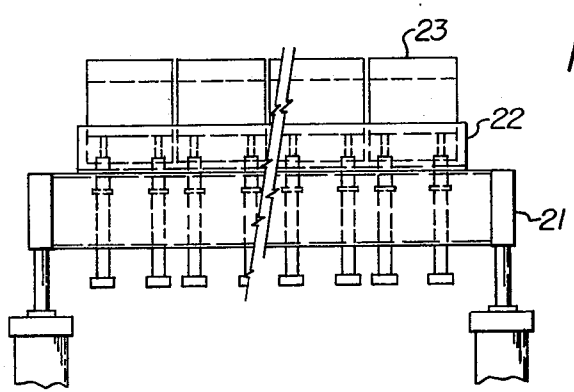

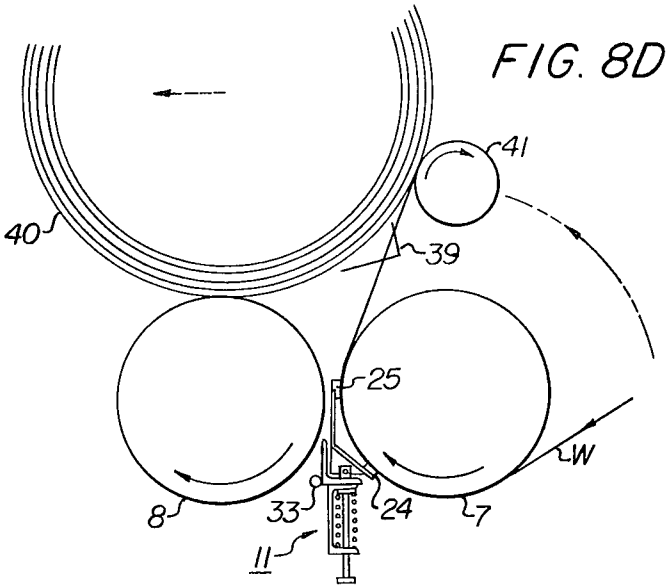
FIG. 8A
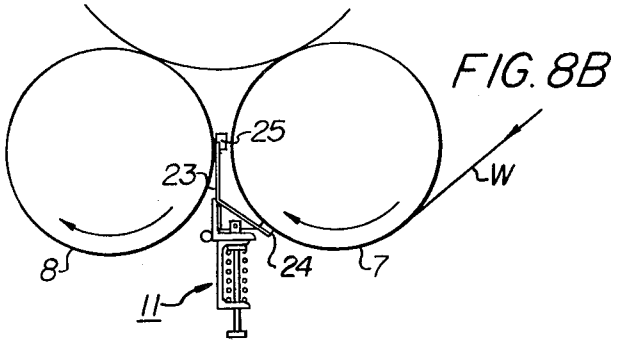
FIG. 8B
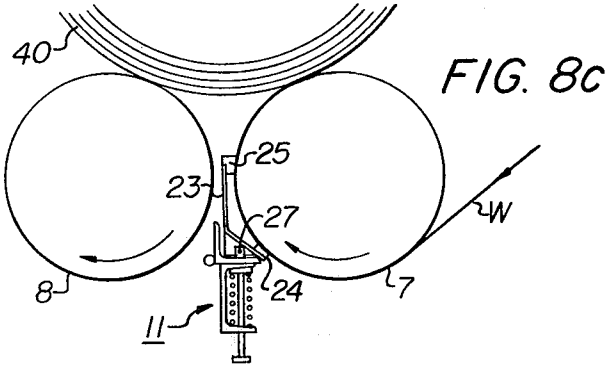
FIG. 8c
FIG. 8D
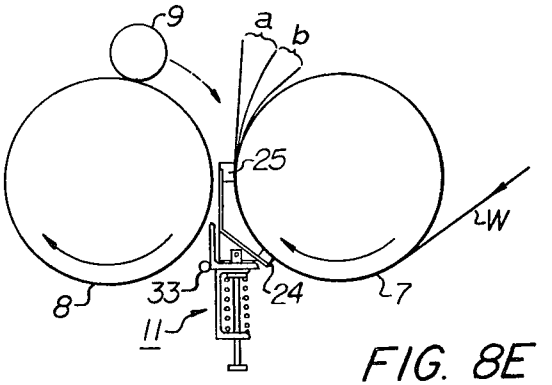
FIG. 8E

AUTOMATIC WEB-WINDING ROUND APPARATUS

BACKGROUND OF THE INVENTION

This invention relates to a remote controlled apparatus for starting a web winding about a core. More specifically, it relates to a two drum winder, wherein the leading end of a severed web is urged around a core to commence being wound thereon, especially without the use of glue or adhesives on the core.

In the papermaking industry, two drum winders, such as shown in FIGS. 1 and 2, are well known. Further, it is well known to provide two drum winders with a web severing means, a means of ejecting a wound web roll from the winder and a means of placing another core into the pocket between the two winding drums. Many designs of this type winder require several operators to glue, paste or tape the leading end of the severed web to the core. This reduces the efficiency of the winder due to the down time required for gluing, pasting or taping of the web to the core. This is especially true when the winder width increases. In addition, the winder may be provided with a web holding roll located underneath the winding drums to prevent the leading end of the severed web from being pulled down between the winding drums due to the tension in the web. With this type of arrangement an air jet can not be placed underneath the winding drums to blow the web away from the winding drum and prevent the web from laying down on the surface of the winding drum, such as shown in FIG. 2. The air jet can only be used to blow the web ahead of the winding drum to reduce the tension in the oncoming web. Therefore, before the core can be placed into the pocket between the winding drums, the operators must lift the sheet off the winding drum and place it over the top of the core before gluing or tapping the web to the core. These disadvantages and others are well known to those skilled in the art and need not be discussed further.

SUMMARY OF THE INVENTION

Accordingly, it is an object of this invention to provide a means which may be remote controlled for starting a web winding about a core on a two drum winder, wherein the leading end of a severed web is urged around a core to commence being wound thereon without the use of adhesives on the core.

The two drum winder of the present invention comprises a pair of winding drums, a rider roll nipping a core against the winding drums and a remote controlled means diverting the leading end of a severed web around the core and through the respective nips about the core, to start the web winding about the core.

DESCRIPTION OF THE DRAWINGS

FIG. 5 is a detailed view of the web holding device shown in FIG. 1;

FIG. 6 is a gage view showing the web holding device taken along line VI—VI in FIG. 5;

FIG. 7 is an enlarged fragmentary view showing the construction of the web holding device shown in FIG. 5;

FIG. 8*a* through 8*e* are illustrative views showing the sequence of the operational steps of the web holding device, shown in FIG. 5;

DESCRIPTION OF THE PREFERRED EMBODIMENT

It should be understood that the showing of the winder is schematic and that only one side of the winder is shown herein, but the supports for various rolls and mechanisms of the winder are at opposite sides of the winder and are substantially the same on each side.

Figure 3:
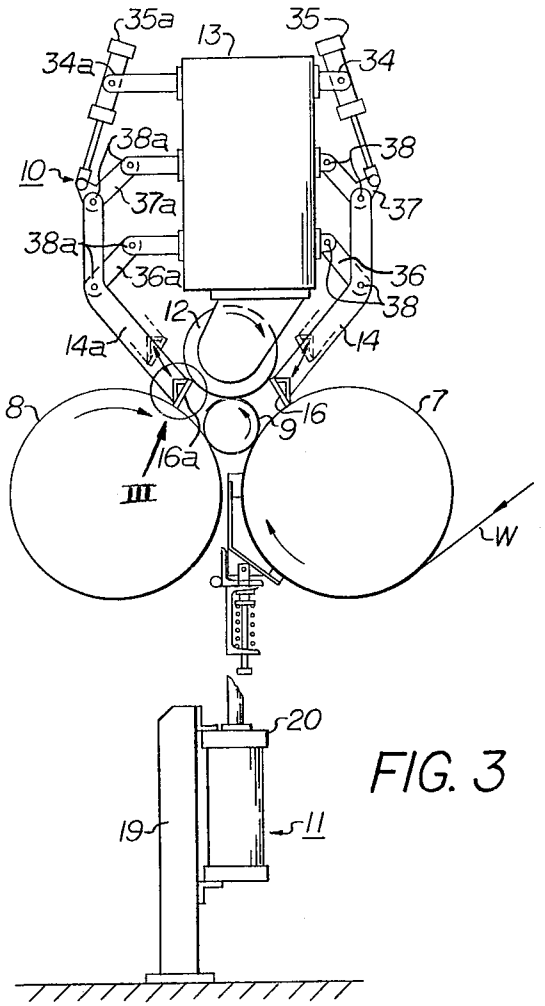
FIG. 3 is a schematic side elevation view of a web winding apparatus constructed in accordance with the principles of the present invention and showing the apparatus in a run position.

The apparatus shown in FIG. 3 is constructed in accordance with the principles of the present invention and generally comprises an automatic web winding apparatus 10 for winding a web W around a core 9 which is supported by a pair of winding drums 7 and 8, and a web holding device 11 which prevents the leading end of a severed web from falling down between the winding drums 7 and 8 prior to starting the web winding about another core.

Figure 4:
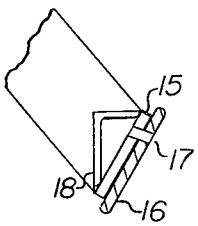
FIG. 4 is an enlarged fragmentary view showing the construction of one of the holding plates.
Figure 1:
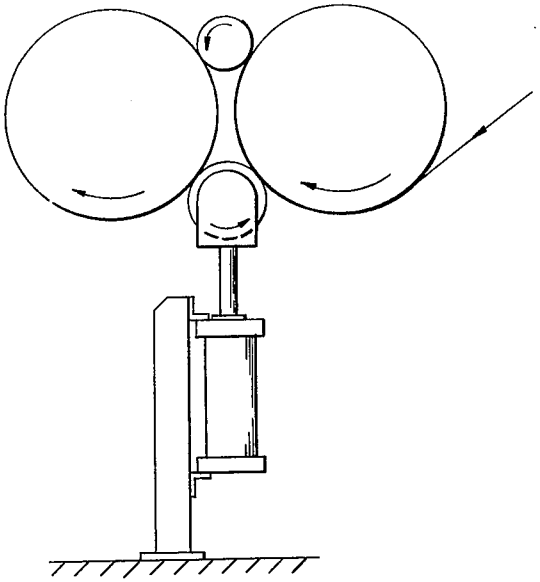
FIG. 1 (PRIOR ART)
FIGS. 1 and 2 are schematic side elevation views showing embodiments of conventional prior art web winding apparatuses.
Figure 2:
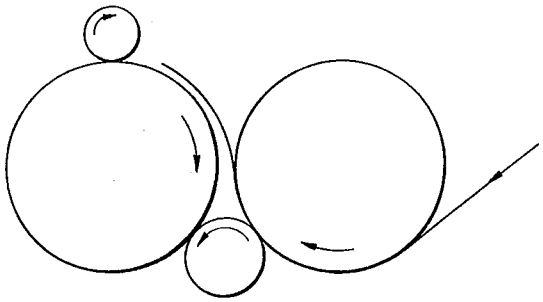
FIG. 2 (PRIOR ART)

The automatic web winding apparatus 10 is mounted on a beam 13 which supports a rider roll 12. Arms 14, 14*a* are provided with plates 15, 15*a* which extend for substantially the width of the machine. The plates 15, 15*a* are adapted to contact both the rider roll 12 and the respective winding drums 7 and 8, thereby enclosing the pockets between them when the core 9 is nipped by the rider roll 12. The surface of the plates 15, 15*a* are provided with covers 16, 16*a*, such as rubber, resin or felt, so that there will be no gap between the winding drums 7 and 8 and the rider roll 12 when the plates are positioned there against. To assist in winding the end of the severed web W around the core 9, plates 15, 15*a* and the covers 16, 16*a* are provided with a series of nozzle holes 17, 17*a* evenly distributed across the machine, through which an air jet can be produced. As shown in FIG. 4, the holding plate 15 includes a wall member 18 to define an air chamber between the holding plate 15 and the wall member 18, through which compressed air can be introduced to produce an air jet through the nozzle hole 17.

The web holding device 11 comprises an air cylinder 20 mounted to a stand 19, and a stop plate 22 mounted to a beam 21 are movable toward and from the winding drums 7 and 8 by the action of the air cylinder 20. FIG. 7 shows in detail the web holding arms 23 and the web holding shoes 24 and 25 which are suitably secured thereto. The holding arm 23 is pivotally mounted on a shaft 26 by a pivot pin 27. The shaft 26 extends through bushings 28 and 29 which are mounted in the beam 21. A spring 30, a retainer flange 31 and a shoulder flange 32 allow a limited up and down movement of the shaft 26 and the holding arm 23. The stop plate 22 limits the pivotally movement of the holding arm 23 about the pivot pin 27. An air pipe 33 having a series of apertures therein is suitably mounted to the side of the stop plate 22.

As shown in FIG. 3, the arms 14, 14*a* are movably supported by a link mechanism comprising cylinders 35, 35*a*, pivotally mounted on brackets 34, 34*a*, lever arms 36, 36*a*, 37, 37*a* and pivot pins 38, 38*a*.

The operational steps of the web holding device 11 are illustrated in FIGS. 8*a* through 8*e* as follows.

FIG. 8*a* shows the web holding device 11 in its retracted position.

FIG. 8*b* shows the web holding device 11 being positioned toward the winding drums with the web holding shoe 24 coming in contact with the winding drum 7.

FIG. 8*c* shows the ascending limit of the web holding device 11 with both the web holding shoes 24 and 25, forcing the web W into contact with the winding drum 7.

FIG. 8*d* shows the web being severed above the web holding shoe 25 by a knife 39 and a wound web roll 40 being ejected from the winder by an ejector roll 41. Roll ejectors and web severing devices are well known and need not be shown or described any further. At the same time, the web above the web holding shoe 25 may be blown back toward the winding drum 7 by an air jet from the air pipe 33.

After the web has been severed, FIG. 8e shows movement of the web prior to the time that the winding core 9 is positioned between the winding drums 7 and 8, wherein the letter (a) shows the movement of a relatively heavy web and the letter (b) shows the movement of a relatively light web toward the winding drum 7.

Figures 9A, 9B, 9C, 9D, 9E, 9F:
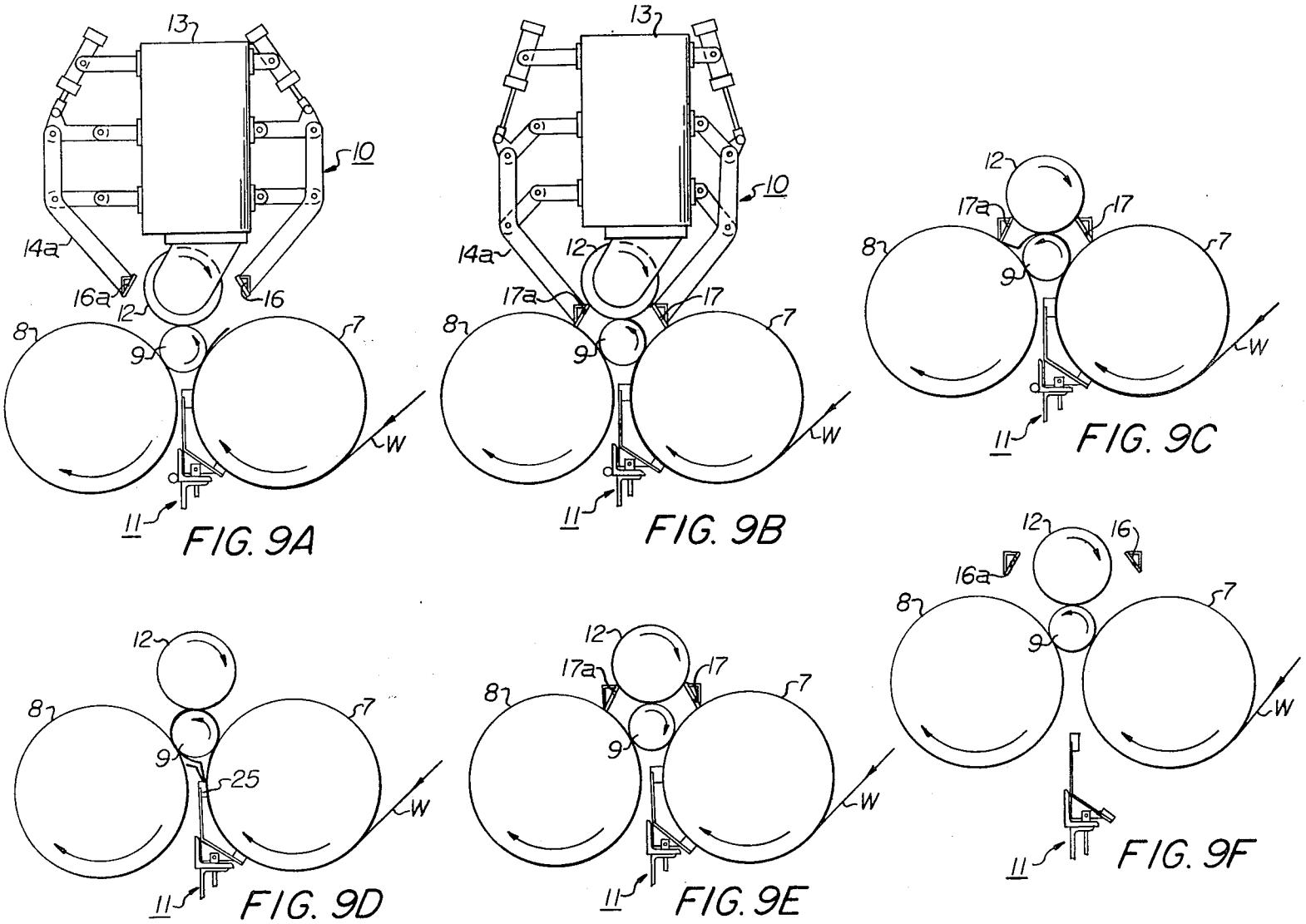
FIGS. 9*a* through 9*f* are illustrative views showing the sequence of the operational steps of the web winding apparatus, shown in FIG. 3.

The operational steps of the automatic web winding device 10 used in conjunction with the web holding device 11 previously described as illustrated in FIGS. 9*a* through 9*f*, as follows. FIG. 9*a* illustrates the core 9 positioned into the pocket between the winding drums 7 and 8 and the rider roll 12 nipping the winding core 9 against the winding drums 7 and 8 and the leading end of the severed web nipped between the core 9 and the winding drum 7.

The arms 14, 14*a* and the plates 15, 15*a* force the covers 16, 16*a* between the rider roll 12 and the winding drums 7 and 8 so that the end of the web nipped between the winding core 9 and the winding drums 7 will come in contact with the cover 16. After contacting the cover 16, the web is diverted into the nip between the rider roll 12 and the winding core 9, as shown in FIG. 9*b*.

The web is folded as it passes through the nip between the core 9 and the rider roll 12. Shown in FIG. 9, the cover 16*a* diverts the web into the nip formed between the core 9 and the winding drum 8.

After passing through the nip, the folded end portion of the web comes in contact with the web holding shoe 25 of the web holding device 11 and by virtue of its movement the web is folded again, as shown in FIG. 9*d*, and diverted into the nip between the winding drum 7 and the core 9.

FIG. 9e shows the folded web passing through the nip between the winding drum 7 and the core 9, thereby completing one full web wrap around the core 9, to start the web winding about the core 9.

FIG. 9f shows the web winding apparatus 10 and the web holding device 11 being retracted to their dormant position. At this time, the winder is accelerated to its normal or desired operational speed.

In FIGS. 9*b*, 9*c* and 9*d*, to facilitate the starting of the web winding around the core 9, air jets from nozzles 17, 17*a* and from the air pipe 33, are used to blow the leading end of the severed web directly into the respective nips, thereby preventing the web from being folded at its end, if it should be desired.

Figure 10:
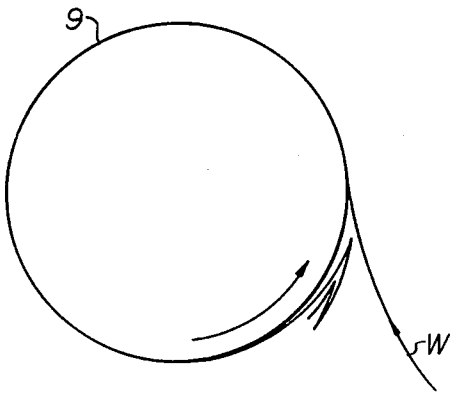
FIG. 10 is an enlarged illustrative view showing the folds in the web just prior to completing one wrap around the core.

FIG. 10 illustrates what the folded web looks like just prior to completing one full wrap about the core 9.

Figure 11:
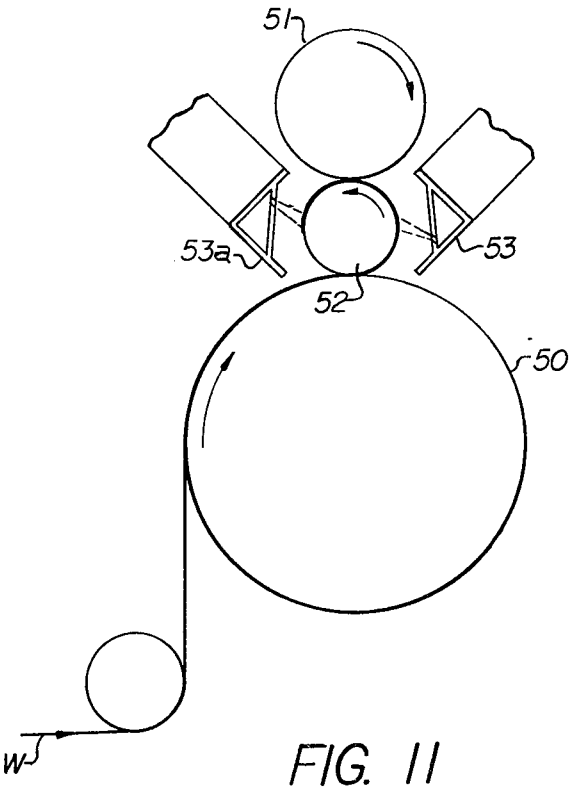
FIG. 11 is an illustrative view showing the principles of the present invention being used on a single drum winder.

It should be understood that the foregoing described apparatus is adaptable to a single drum winder, as illustrated in FIG. 11. As shown, a core 52 is being nipped to a winder drum 50 by a rider 51. Web directing members 53, 53*a* are provided to divert the web W around the core 52. Web directing member 53 diverts the leading of a severed web upward into the nip between the core 52 and the rider roll 51. Web directing member 53*a* diverts the web downward into the nip between the core 52 and the winder drum 50 to start the web winding about the core 52.

Further, it should be understood that the present invention is adaptable to a two drum winder, wherein the winding drums are positioned vertically one above the other in a spaced relationship, such as shown in U.S. Pat. No. 3,383,064.

While the form of the invention now preferred has been disclosed as required of the statutes, other forms may be used, all coming within the scope of the claims which follows:

What is claimed is:

1. An apparatus for starting a web wrapping a core on a two drum winder, said winder comprising a first winding drum and a second winding drum, said winding drums being positionable on the same horizontal level, a rider roll nipping the core against said winding drums and being positionable above said winding drums, first and second web directing members, means to move said web directing members into contact with said rider roll and said winding drums, and means to move said members out of contact with said rider roll and said respective drums, a web holding means located beneath said winding drums, means to raise said web holding means into engagement with said web and hold said web in contact with one of said winding drums, means to maintain said web holding means into engagement with said web thereby preventing the web from falling between said winding drums;

said first web directing member in its contact position being arranged to divert the web into the nip between said rider roll and said core, said second web directing member in its contacting position being arranged to divert the web into the nip between said second winding drum and said core, a third web directing means being arranged to direct the web upwardly into the nip between said first winding drum and said core, said third web directing means being said web holding means, said first, second and third web directing means thereby wrapping the web around said core without utilizing any external fastening means.

2. The apparatus constructed in accordance with claim 1 wherein said first and second directing members and said web holding means include means producing air jets to assist in diverting the web around the core.

3. The apparatus constructed in accordance with claim 1 and further including roll ejection means, said roll ejecting means removing said wound roll from the two drum winder when said first and second web directing means are in the out of contact position with said rider roll and said drum.

* * * * *